US011857844B2

(12) United States Patent
Steinmann et al.

(10) Patent No.: US 11,857,844 B2
(45) Date of Patent: Jan. 2, 2024

(54) FOOT WORN AQUATIC FIN

(71) Applicant: SWUNNING SÀRL, Pully (CH)

(72) Inventors: Thomas Steinmann, Lausanne (CH); Marc Habisreutinger, St-Sulpice (CH)

(73) Assignee: SWUNNING SÀRL, Pully (CH)

( * ) Notice: Subject to any disclaimer, the term of this patent is extended or adjusted under 35 U.S.C. 154(b) by 43 days.

(21) Appl. No.: 18/008,924

(22) PCT Filed: Jun. 2, 2021

(86) PCT No.: PCT/EP2021/064867
§ 371 (c)(1),
(2) Date: Dec. 7, 2022

(87) PCT Pub. No.: WO2021/249851
PCT Pub. Date: Dec. 16, 2021

(65) Prior Publication Data

US 2023/0191202 A1 Jun. 22, 2023

(30) Foreign Application Priority Data

Jun. 11, 2020 (EP) ..... 20179588

(51) Int. Cl.
*A63B 31/14* (2006.01)
*A63B 31/11* (2006.01)

(52) U.S. Cl.
CPC ..... *A63B 31/14* (2013.01); *A63B 2031/115* (2013.01)

(58) Field of Classification Search
CPC ..... A63B 31/00; A63B 31/08; A63B 31/10; A63B 31/11; A63B 2031/112; A63B 2031/115; A63B 31/12; A63B 31/14
(Continued)

(56) References Cited

U.S. PATENT DOCUMENTS 3,081,467 A * 3/1963 Ciccotelli ..... A63B 31/14 441/63
3,665,535 A * 5/1972 Picken ..... A63B 31/11 441/64

(Continued)

FOREIGN PATENT DOCUMENTS

EP 0 998 962 5/2000
EP 0998962 B1 12/2008

(Continued)

OTHER PUBLICATIONS

International Search Report for PCT/EP2021/064867, dated Sep. 1, 2021, 3 pages.

(Continued)

*Primary Examiner* — Daniel V Venne
(74) *Attorney, Agent, or Firm* — Nixon & Vanderhye P.C.

(57) ABSTRACT

Aquatic activity fin (1) comprising a foot support portion (2) configured for fixing to a person's foot, and a fin portion (3) extending from the foot support portion substantially along a base plane (P). The fin portion (3) comprises a support frame (4), a plurality of hydrofoil blades (5) mounted pivotally to the support frame (4) via pivot couplings (6), and a mechanism for limiting the maximum blade pivot angle β of each hydrofoil blade. The mechanism for limiting the maximum blade pivot angle comprises bidirectional angle stops (7) configured to allow pivoting of the hydrofoil blade from the a thrust position where a trailing edge (9*b*) of the hydrofoil blade is above said base plane (P), to a return position where the trailing edge (9*b*) is below said base plane (P).

14 Claims, 4 Drawing Sheets

Figure 1A:
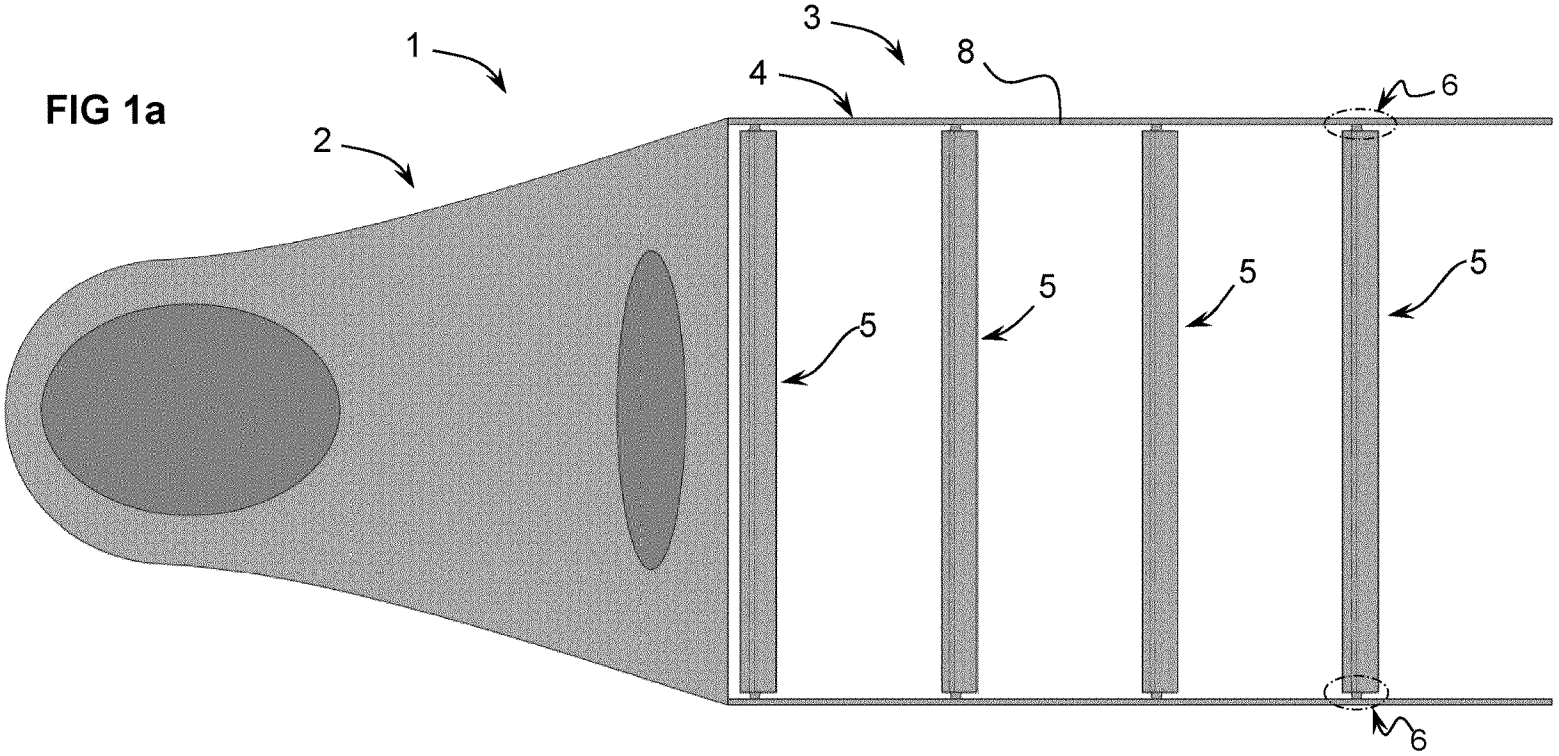

(58) Field of Classification Search
USPC ..... 441/55, 60, 61, 64
See application file for complete search history.

(56) References Cited

U.S. PATENT DOCUMENTS 3,952,351 A * 4/1976 Gisbert ..... A63B 31/14 441/64
4,178,128 A * 12/1979 Gongwer ..... B63H 1/36 441/62
4,689,029 A * 8/1987 Ciccotelli ..... A63B 31/11 441/64
4,767,786 A * 8/1988 Farrish ..... A61K 31/195 514/561
4,944,703 A 7/1990 Mosier
5,326,296 A * 7/1994 De Jesus ..... A63B 31/11 441/60
5,330,377 A * 7/1994 Kernek ..... A63B 31/11 441/64
5,536,190 A 7/1996 Althen
6,109,990 A * 8/2000 Lundberg ..... A63B 21/0084 441/64
8,480,446 B2 * 7/2013 Woods ..... A63B 31/11 441/64
8,900,023 B2 * 12/2014 Wallmark ..... A63B 31/11 441/63
8,926,385 B1 * 1/2015 Woods ..... A63B 31/11 441/64
2012/0115377 A1 5/2012 Woods

FOREIGN PATENT DOCUMENTS

FR 2 931 690 12/2009
WO 2010/140965 12/2010

OTHER PUBLICATIONS

Written Opinion of the ISA for PCT/EP2021/064867, dated Sep. 1, 2021, 7 pages.

* cited by examiner

L
C
11
10
V
10a
$F_{thrust}$
$F_{lift}$
A
P
γ

V
α
β
6a
10b
P
γ
10
7b
C
11
$F_{drag}$
$F_{lift}$

FOOT WORN AQUATIC FIN

CROSS-REFERENCE TO RELATED APPLICATION(S)

This application is the U.S. national phase of International Application No. PCT/EP2021/064867 filed Jun. 2, 2021 which designated the U.S. and claims priority to EP 20179588.7 filed Jun. 11, 2020, the entire contents of each of which are hereby incorporated by reference.

The present invention relates to a foot worn fin for aquatic activities, in particular for aquatic exercises, training and sports.

A large variety of swimming fins are known and generally serve the purpose of increasing the thrust swimmers may exert in water to swim faster, or over longer distances, or for longer durations. Conventional fins typically have a supple single blade that bends depending on the direction of movement of the swimmers foot. It is however known to provide multi-vane fins intended to increase the hydrodynamic thrust that may be generated by the swimmer or for increased speed and efficiency. It is further known to have multi-vane fins having blades that are bendable or pivotable in order to reduce drag while increasing thrust during the swimming stroke, for instance as described in U.S. Pat. No. 4,944,703A, FR2931690A1, US2012/115377A1, EP998962A1, WO2010/140965A1, U.S. Pat. No. 5,536,190A. In all of these documents, the purpose of the hydrofoil blades pivoting from one side of the base plane to the other side of the base plane is to increase efficiency and thrust for swimming.

Conventional swimming fins as described in the aforementioned documents are however not generally well adapted for certain aquatic exercises, for instance stationary or slow movement in water, movement in a generally upright position of the swimmer, or for rapid changes in the swimmer's posture and direction of movement. They are in particular not adapted for use in a treading motion. The aforementioned may be desirable for certain aquatic activities, whether recreational, for exercise and training, or for professional purposes.

It is an object of this invention to provide a foot worn fin for aquatic activities that has a high hydrodynamic efficiency yet is well adapted for both stationary and dynamic swimming patterns, and in particular that is well adapted for a treading motion.

It is advantageous to provide a swimming fin that is compact and cost-effective.

It is advantageous to provide a swimming fin that is robust, simple and reliable.

Objects of the invention have been achieved by providing a foot worn aquatic activity fin according to claim 1.

Dependent claims recite various advantageous features of the invention.

Disclosed herein is an aquatic activity fin comprising a foot support portion configured for fixing to a person's foot, and a fin portion extending from the foot support portion substantially along a base plane. The fin portion comprises a support frame, a plurality of hydrofoil blades mounted pivotally to the support frame via pivot couplings, and a mechanism for limiting the maximum blade pivot angle β of each hydrofoil blade.

The mechanism for limiting the maximum blade pivot angle comprises bidirectional angle stops configured to allow pivoting of the hydrofoil blade from the a thrust position where a trailing edge of the hydrofoil blade is above said base plane, to a return position where the trailing edge is below said base plane.

The bidirectional angle stops are configured to stop the hydrofoil blade in a thrust position such that an angle of a chord line of the hydrofoil blade with respect to the base plane is in a range of 3 to 30 degrees, preferably in a range of 5 to 20 degrees.

The bidirectional angle stops are further configured to stop the hydrofoil blade in a return position such that an angle of a chord line of the hydrofoil blade with respect to the base plane P is in a range of 70 to 90 degrees, preferably in a range of 75 to 85 degrees.

In an advantageous embodiment, the bidirectional angle stops are configured to allow a maximum blade pivot angle β of between 60 and 120 degrees preferably of between 70 and 120 degrees, preferably in a range between 80 and 115 degrees.

In an advantageous embodiment, the plurality of hydrofoil blades are arranged in juxtaposed manner substantially along the base plane P, the pivot axis of adjacent hydrofoil blades being separated by a distance D greater than a chord length L of each hydrofoil blade.

In an advantageous embodiment, the pivot axis of the pivot coupling is positioned substantially at a center between the hydrofoil blade maximum thickness D2.

In an advantageous embodiment, a ratio D2/L between a blade maximum thickness D2 and chord length L of each hydrofoil blade is in a range between 1/5 and 1/20, for instance around 1/10.

In an advantageous embodiment, the number of juxtaposed hydrofoil blades is in a range of 3 to 6, preferably 4 or 5.

In an advantageous embodiment, the support frame comprises a pair of side bars extending from the foot portion and separated by a gap within which the hydrofoil blades are mounted.

In an advantageous embodiment, the pair of side bars are substantially parallel.

In an advantageous embodiment, the pivot coupling comprises a pivot bearing pin on one of the hydrofoil blade and support frame and a pivot bearing orifice on the other of the hydrofoil blade and support frame.

In an advantageous embodiment, the bidirectional angle stops comprises a pin on one of the hydrofoil blade and support frame, engaging in a curved slot on the other of the hydrofoil blade and support frame.

In an advantageous embodiment, the slot is provided in side bars of this support frame and the pin extends from lateral sides of the hydrofoil blade.

In an advantageous embodiment, the hydrofoil blade comprises a symmetrical hydrofoil profile in which a mean camber line is coincident with a chord line of the blade.

Figure 1B:
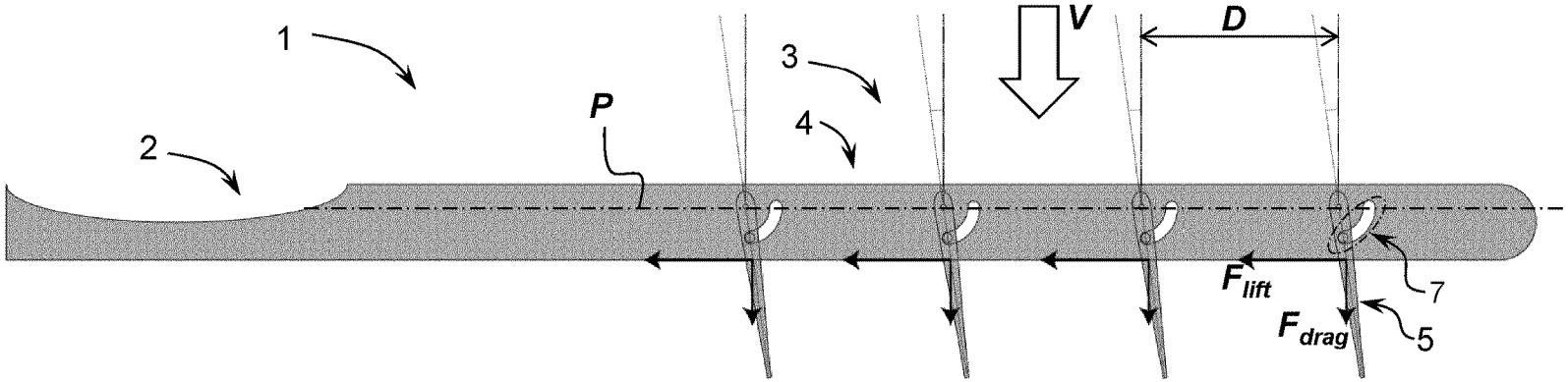

Further objects and advantageous features of the invention will be apparent from the claims, from the detailed description, and annexed drawings, in which:

FIG. 1*a* is a schematic top view of a foot worn aquatic activity fin according to an embodiment of the invention, showing hydrofoil blades of the fin in a position corresponding to a return movement of the fin in water;

FIG. 1*b* is a schematic side view of the fin of FIG. 1*a;*

Figure 2A:
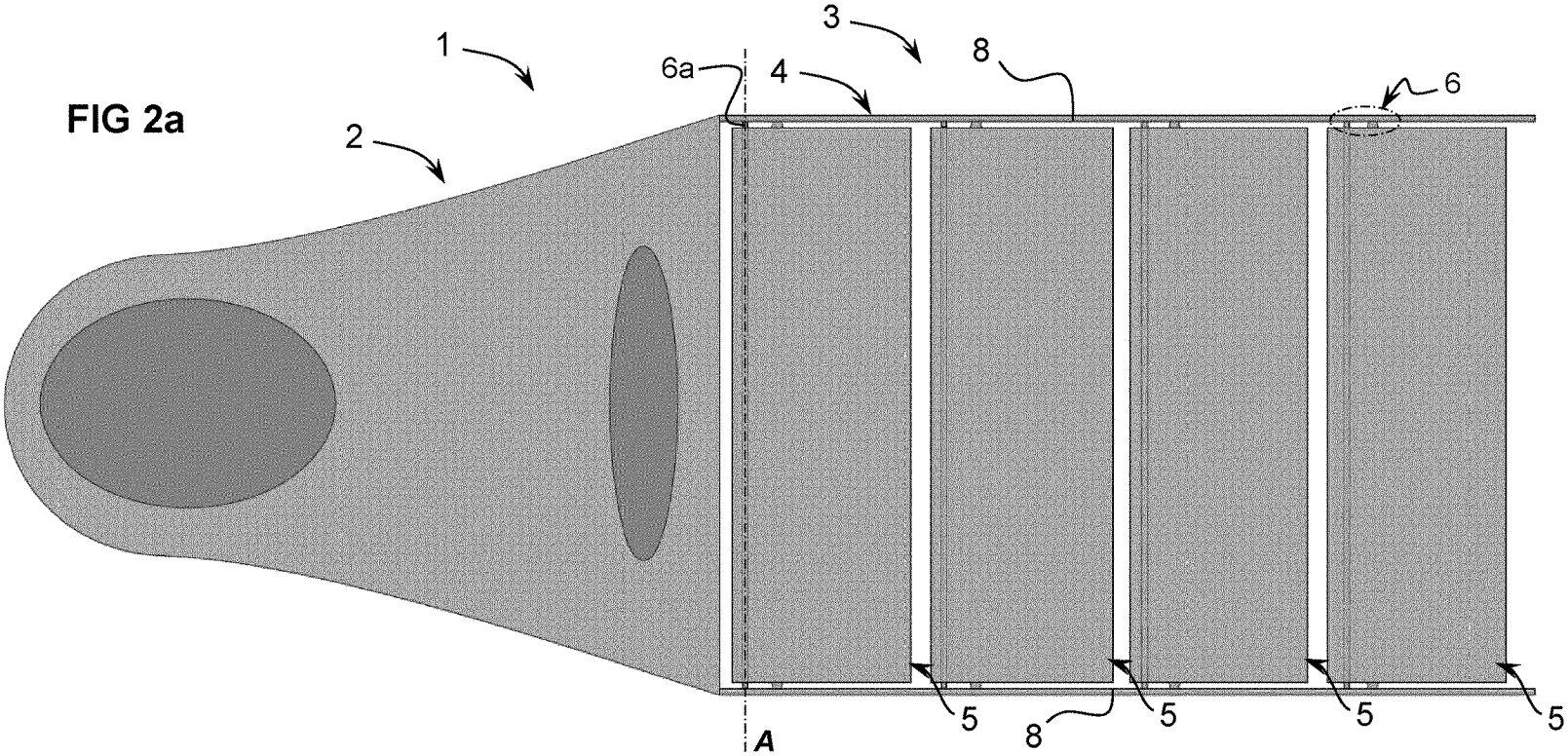
Figure 2B:
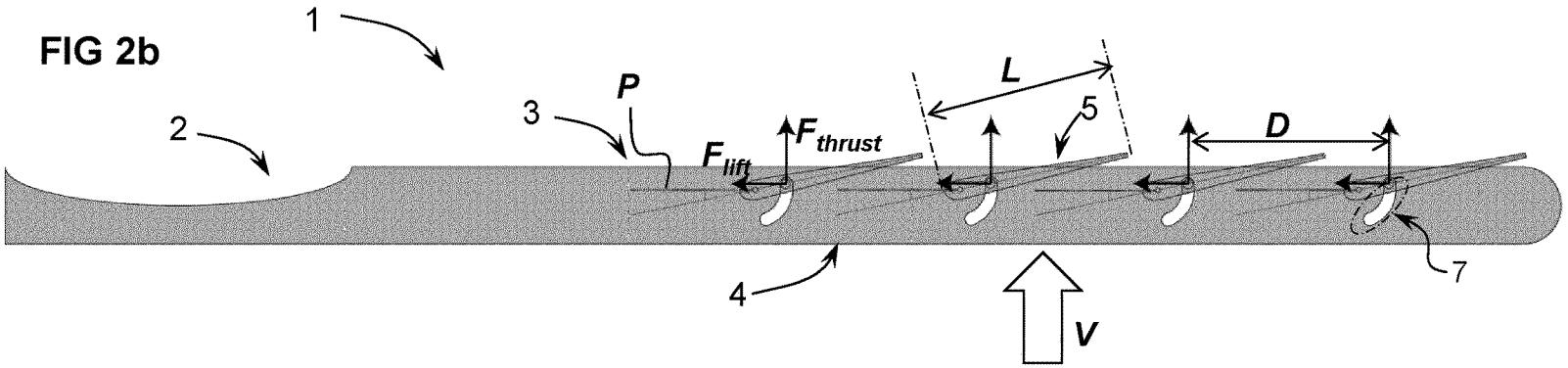

FIG. 2*a* is a view similar to FIG. 1*a*, showing the hydrofoil blades in a position producing maximum thrust;

FIG. 2*b* is a side view of the fin of FIG. 2*a;*

Figures 3A, 3B:
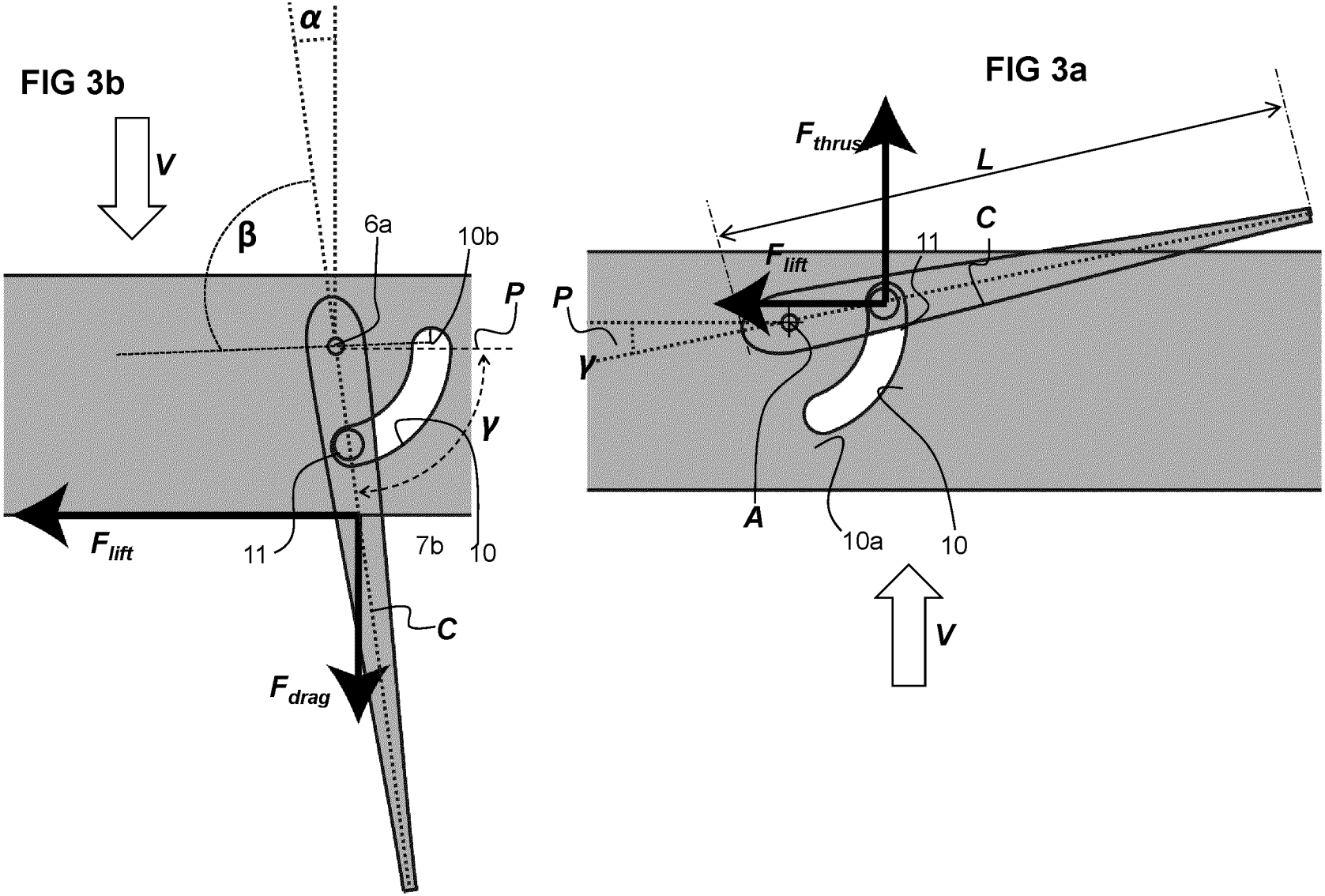

FIG. 3*a* is a detail view of a portion of FIG. 1*b;*

FIG. 3*b* is a detail view of a portion of FIG. 2*b;*

Figure 4:
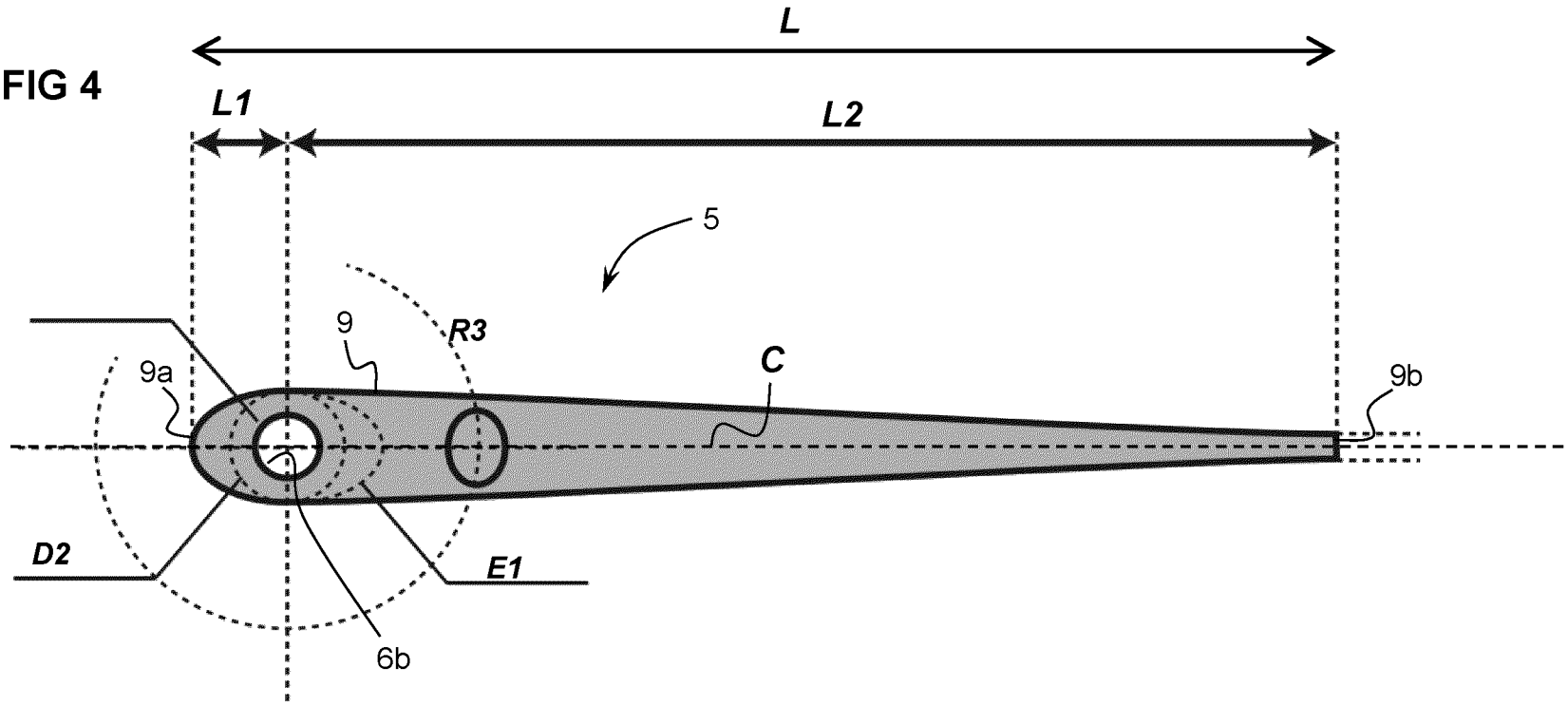

FIG. 4 is a detail side view of a hydrofoil blade of a fin according to an embodiment of the invention.

Referring to the figures, an aquatic activity fin 1 according to embodiments of the invention, comprises a foot support portion 2 configured to be worn on a person's foot, and a fin portion 3 fixed to and extending from the foot support portion 2. The fin portion 3 extends generally along a base plane P that is generally parallel to the sole of a wearer's foot, similar to a general configuration of a conventional swimming fin. The foot support portion 2 is illustrated very schematically and may have any per se known configurations for attaching a swimming fin to a person's foot, including for instance a shoe portion or a strap to hold a person's foot to the fin.

The fin portion 3 comprises a support frame 4 and a plurality of hydrofoil blades 5 mounted to the support frame 4 via pivot couplings 6.

In the illustrated embodiment, the support frame 4 comprises a pair of side bars 8 on opposed lateral sides of the fin portion and receiving therebetween the hydrofoil blades 5 that are pivotally coupled to the support frame bars. The side bars 8 may for instance comprise substantially flat and linear bars, however various profiled rods, bars and other structural elements may be provided to form the support frame.

In the illustrated embodiment, the side bars 8 of the support frame 4 are arranged in a substantially parallel manner such that the gap therebetween defining the width of the hydrofoil blades is substantially constant. However, within the scope of the invention, the side bars 8 may be non-parallel and may either diverge away from the foot portion or converge from the foot portion towards the extremities of the support frame and such that different hydrofoil blades 5 have different widths spanning between the side bars 8. The diverging, respectively converging shapes for increasing, respectively decreasing hydrofoil blade widths may be configured to adjust the thrust produced by the hydrofoil blades as a function of the distance of the blade from the foot portion 2. The side bars 8 may further have non-linear shapes and may further curve upwards or downwards away from the generally base plane P aligned with the wearer's foot sole, depending on the hydrodynamic properties that are desired from the fin portion 3. The desired hydrodynamic properties of the fin portion may for instance depend on the type of activity intended for the fin, for instance mainly stationary, slow moving, "walking" or "running" exercises in water, or for generating maximum thrust for swimming.

The return displacement of the fin with respect to the water flow direction V is illustrated in FIGS. 1*a*, 1*b* and 3*a*, and the thrust position with respect to the water flow direction V is illustrated in FIGS. 2*a*, 2*b* and 3*b*.

Each hydrofoil blade 5 comprises a hydrofoil surface 9 extending from a leading edge 9*a* to a trailing edge 9*b*. The hydrofoil surfaces may have a symmetric or substantially symmetric profile with respect to the chord line C which may thus correspond to a mean camber line of the hydrodynamic hydrofoil profile. Within the scope of the invention it is however possible to have a non-symmetric hydrofoil profile for adjusting the relationships between the drag force $F_{drag}$, thrust force $F_{thrust}$, and lift force $F_{lift}$ of the fin moving in the return, respectively thrust directions. Such adjustment may depend on the intended application, in order to optimize a particular hydrodynamic behavior of the fin. Moreover, the blade leading edge maximum thickness D2, the blade chord length L, and the hydrofoil profile 9 (depending inter alia on the mean camber line) may all be varied to adjust hydrodynamic properties of the blades. The aforementioned properties may be adjusted using conventional simulation methods used for hydrofoils.

In the present invention, for aquatic activities including swimming, treading in water and advancing in water using "walking" or "running" movements, advantageous dimensions of the hydrofoil blades for adults are advantageously in the ranges of:

D2 preferably is in a range from 2 to 4 mm,

L preferably is in a range from 40 to 80 mm,

L/R preferably is in a range from 2 to 20.

The preferred width of the hydrofoil blades ranges from 150 to 250 mm.

The pivot coupling 6 may comprise a pivot bearing rod or pin 6*a* on one of the support frame and hydrofoil blade, and a complementary pivot bearing orifice 6*b* on the other of the support frame and hydrofoil blade. The pivot coupling allows the hydrofoil blade to rotate around a pivot axis A that is arranged substantially orthogonal to the direction of the support frame 4 extending from the foot support portion 2.

In the illustrated embodiment, the pivot axis A is positioned substantially at a position where the blade has its maximum thickness D2, which is situated proximal the leading edge 9*a*.

In the illustrated embodiment, the hydrofoil blade is provided with a pin 6*a* that is rotatable received within a pivot bearing orifice 6*b* in the side bars 8, however as indicated above, the pin may be provided on the side bars and engage in a corresponding orifice within the hydrofoil blade, or in another variant, a separate pin may be inserted into orifices in the support frame side bars and hydrofoil blade. In another variant, the pivot coupling 6 may be an elastically deformable coupling interconnecting the hydrofoil blade and the support frame.

The fin portion 3 further comprises bidirectional angle stops 7 that define a maximum rotation angle β of the blade.

In preferred embodiments, the maximum blade pivot angle β is in a range of 60 to 120 degrees preferably in a range of 70 to 120 degrees preferably in a range of 80 to 115 degrees.

The bidirectional angle stops are configured such that, in the thrust position as illustrated in FIGS. 2*a*, 2*b* and 3*b*, the hydrofoil blade 5 trailing edge 9*b* is positioned above the base plane P, whereas in the return position as illustrated in FIGS. 1*a*, 1*b* and 3*a*, the blade trailing edge 9*b* is positioned below the base plane P.

The bidirectional angle stops 7 may advantageously be arranged to stop the hydrofoil blade 5 in:

- a thrust position such that an angle γ of the chord line C of the hydrofoil blade with respect to the base plane P is in a range of 3 to 30 degrees, preferably in a range of 5 to 20 degrees.
- a return position such that the angle γ of chord line C of the hydrofoil blade with respect to the base plane P is in a range of 70 to 90 degrees, preferably in a range of 75 to 85 degrees.

The plurality of blades 5 arranged in a juxtaposed manner substantially along the base plane P, are spaced apart at a distance D greater than the chord length L of the blade (D>L) such that the blades can pivot across the base plane P without interfering with each other. An important advantage of this characteristic is that, in the maximum thrust position as illustrated in FIGS. 2*a*, 2*b* and 3*b*, the water flow over the hydrofoil blade 5 produces not only a thrust force component $F_{thrust}$ but also a lift force component $F_{lift}$ that allows a swimmer to efficiently remain in a stationary or in a slowly advancing or retreating movement in water by treading water or performing a walking or running movement in water in an efficient manner.

Typically, with respect to the surface of the water (i.e. a horizontal plane), the base plane of the fin during a treading or walking movement may be at an angle for example of between 0 and 90 degrees, whereby the resultant force from the thrust force $F_{thrust}$ and lift force $F_{lift}$ acts upon the wearer in a direction that may be vertical, or close to the vertical depending on whether a slow advancing movement or a slow reversing movement in water is desired. This movement can thus easily and efficiently adjust a stationary treading or advancing walking movement in water with easy and natural movements of the swimmer's limbs.

Moreover, on the return movement, the hydrofoil blades 5 are further configured to produce a lift force $F_{lift}$ to lift upwards the swimmer.

The fins according to embodiments of the invention can thus be used to allow the swimmer to perform a movement that is similar to a walking or running movement on land. Such walking in water movements may be used in physiotherapy and other forms of exercise training or may be used in water sports. A running or walking movement practiced in water without the present invention does not allow the swimmer to float or advance due to the symmetrical back and forth forces of oppositely moving legs. The fins according to embodiments of the invention however allow a swimmer both to advance and to rise in the water by practicing the movements of walking or running, due to the rotation of the hydrofoil blades induced by the movement of the fin, and the control of this rotation obtained with the bidirectional stops.

The bidirectional angle stops 7 may be formed in various manners, comprising an abutment shoulder on one of the hydrofoil blade and support frame, and a corresponding guide slot on the other of the hydrofoil blade and support frame. The guide slot provides abutment shoulders at its ends to define the maximum angle of rotation β of the blade 5. For instance, in the illustrated example, the bidirectional angle stops 7 comprise a slot 10 formed within the side bars 8 of the support frame 4, and a pin 11 received within the slot 10, the pin movable between a first end 10*a* of the slot and a second end 10*b* of the slot, defining the maximum angle of rotation β. The skilled person would however appreciate that various other configurations defining the stops and maximum angle of rotation of the blade with respect to the support frame may be implemented.

It will also be appreciated that the number of juxtaposed hydrofoil blades 5 may be varied, for instance having a greater number of hydrofoil blades with shorter chord length or a lower number of blades each with an increased chord length, depending also on the overall length of the fin portion 3.

Moreover, within the scope of the invention, it may be appreciated that there may be more than a single hydrofoil blade extending across the width of the fin portion, for instance the support frame may comprise a central support bar such that there are a pair of blades aligned along the pivot axis.

However, for an optimal cost to performance ratio, the number of hydrofoil blades is preferably in a range of 3 to 6, for instance 4 or 5.

LIST OF REFERENCES USED

- Aquatic activity fin 1
  - Foot support portion 2
    - (sock, strap, etc)
  - Fin portion 3
    - support frame 4
      - side bars 8
    - hydrofoil blade 5
      - hydrofoil surface 9
        - leading edge 9*a*
        - leading edge radius R1
        - trailing edge 9*b*
    - pivot coupling 6
      - pivot bearing rod/pin 6*a*
      - pivot bearing orifice 6*b*
      - pivot axis A
    - bidirectional angle stops 7
      - slot 10
        - first and second ends 10*a*, 10*b*
      - pin 11
- Water Flow Direction V
- base plane P
  - (maximum) blade pivot angle β
- angle of incidence α
- blade chord length L
  - Axis to leading edge L1
  - Axis to trailing edge L2

$(L1+L2=L)$

- Blade leading edge maximum thickness D2 (diameter D2)
- distance between pivots D
- pivot to stop distance R3 (radius R3)
- Lift force $F_{lift}$
- Drag force $F_{drag}$
- Thrust force $F_{drag}$
- hydrofoil profile
  - chord line C
  - mean camber line

The invention claimed is:

1. Aquatic activity fin comprising a foot support portion configured for fixing to a person's foot, and a fin portion extending from the foot support portion substantially along a base plane (P), the fin portion comprising a support frame, a plurality of hydrofoil blades mounted pivotally to the support frame via pivot couplings, and a mechanism for limiting the maximum blade pivot angle β of each hydrofoil blade, the mechanism for limiting the maximum blade pivot angle comprising bidirectional angle stops configured to allow pivoting of the hydrofoil blade from the a thrust position where a trailing edge of the hydrofoil blade is above said base plane (P), to a return position where the trailing edge is below said base plane (P) characterized in that the bidirectional angle stops are configured to stop the hydrofoil blade in the thrust position such that an angle (γ) of a chord line (C) of the hydrofoil blade with respect to the base plane (P) is in a range of 3 to 30 degrees, and in that the bidirectional angle stops are configured to stop the hydrofoil blade in the return position such that an angle of the chord line (C) of the hydrofoil blade with respect to the base plane P is in a range of 70 to 90 degrees.

2. Aquatic activity fin according to claim 1, wherein the bidirectional angle stops are configured to allow a maximum blade pivot angle β of between 60 and 120 degrees preferably of between 70 and 120 degrees, preferably in a range between 80 and 115 degrees.

3. Aquatic activity fin according to claim 1, wherein the bidirectional angle stops are configured to stop the hydrofoil blade in the thrust position such that the angle (γ) of the chord line (C) of the hydrofoil blade with respect to the base plane (P) is in a range of 5 to 20 degrees.

4. Aquatic activity fin according to claim 1, wherein the bidirectional angle stops are configured to stop the hydrofoil blade in the return position such that an angle of the chord line (C) of the hydrofoil blade with respect to the base plane P is in a range of 75 to 85 degrees.

5. Aquatic activity fin according to claim 1, wherein the plurality of hydrofoil blades are arranged in juxtaposed manner substantially along the base plane (P), the pivot axis of adjacent hydrofoil blades being separated by a distance (D) greater than a chord length (L) of each hydrofoil blade.

6. Aquatic activity fin according to claim 1, wherein the pivot axis (A) of the pivot coupling is positioned substantially at a center between the hydrofoil blade maximum thickness (D2).

7. Aquatic activity fin according to claim 1, wherein a ratio (D2/L) between a blade maximum thickness (D2) and chord length (L) of each hydrofoil blade is in a range between 1/5 and 1/20, for instance around 1/10.

8. Aquatic activity fin according to claim 1, wherein the number of juxtaposed hydrofoil blades is in a range of 3 to 6, preferably 4 or 5.

9. Aquatic activity fin according to claim 1, wherein the support frame comprises a pair of side bars extending from the foot portion and separated by a gap within which the hydrofoil blades are mounted.

10. Aquatic activity fin according to claim, 9 wherein the pair of side bars are substantially parallel.

11. Aquatic activity fin according to claim 1, wherein the pivot coupling comprises a pivot bearing pin on one of the hydrofoil blade and support frame and a pivot bearing orifice on the other of the hydrofoil blade and support frame.

12. Aquatic activity fin according to claim 1, wherein the bidirectional angle stops comprises a pin on one of the hydrofoil blade and support frame, engaging in a curved slot on the other of the hydrofoil blade and support frame.

13. Aquatic activity fin according to claim 12, wherein the slot is provided in side bars of this support frame and the pin extends from lateral sides of the hydrofoil blade.

14. Aquatic activity fin according to claim 1, wherein the hydrofoil blade comprises a symmetrical hydrofoil profile in which a mean camber line is coincident with a chord line (C) of the blade.

* * * * *